US005809671A

United States Patent [19]

Sinykin

[11] Patent Number: 5,809,671

[45] **Date of Patent: *Sep. 22, 1998**

[54] TILLER WITH ADJUSTABLE DEPTH CUTTER AND SNOW COMB ENTRY ANGLE

[75] Inventor: William B. Sinykin, Smithfield, Utah

[73] Assignee: LMC Operating Corp., Logan, Utah

[ * ] Notice: The term of this patent shall not extend beyond the expiration date of Pat. No. 5,632,106.

[21] Appl. No.: 858,531

[22] Filed: May 19, 1997

Related U.S. Application Data

[63] Continuation-in-part of Ser. No. 512,289, Aug. 8, 1995, Pat. No. 5,632,106.

[51] Int. Cl.[6] ..... E01H 5/04

[52] U.S. Cl. ..... 37/219; 37/222; 172/250

[58] Field of Search ..... 37/220, 221, 222, 37/219, 224, 260, 261, 269, 226; 172/112, 72

[56] References Cited

U.S. PATENT DOCUMENTS 5,632,106 5/1997 Sinykin ..... 37/222

*Primary Examiner*—Michael J. Carone
*Assistant Examiner*—Robert Pezzuto
*Attorney, Agent, or Firm*—A. Ray Osburn

[57] ABSTRACT

A snow tiller for ski slopes having rotating cutter bars with outstanding teeth. The cutter bars are each installed beneath a cover which directs the snow rearwardly to a snow smoothing comb. Each cover is adjustable in geometry to provide either greater or less angle of entry of the snow beneath the snow comb, and the change of angle is coordinated with changes in depth of snow cutting by the cutter bar teeth. A double acting hydraulic cylinder and ram assembly links cutter bar mounting frames, and is used to control the longitudinal angles of the cutter bars upon the snow.

7 Claims, 12 Drawing Sheets

TILLER WITH ADJUSTABLE DEPTH CUTTER AND SNOW COMB ENTRY ANGLE

RELATED APPLICATIONS

This application is a continuation-in-part of application, Ser. No. 08/512,289, filed Aug. 8, 1995, now U.S. Pat. No. 5,632,106, having the same title.

BACKGROUND OF THE INVENTION

1. Field

The field of the invention is snow grooming devices for ski slopes and runs and, more particularly snow tillers for chopping and powderizing snow surfaces.

2. State of the Art

Snow grooming devices include vehicle mounted snow plow blades, compactors which firm up deep loose snow and snow tillers. The latter is a very important, perhaps principally necessary, device. It comprises an elongate device known as a cutter bar or drum, being an elongate hollow tubular member with outstanding snow chopping and pulverizing teeth. With this device, powered generally by hydraulic motors carried upon the tiller device itself, quite hard and icy paths may be efficiently converted into skiable surfaces. Typically, the cutter bar is mounted rotatably to a frame at each of its ends, inside a covering canopy sometimes called an apron and at other times called a "box". This cutter bar covering member is mounted to the same frame as the cutter bar, and terminates at a rearward edge in a snow grooming device sometimes called a smoothing bar and sometimes a snow comb. Recently, it has become popular to provide two or three such cutter bar and frames flexibly joined as units at their ends. U.S. Pat. No. 5,067,264 discloses such a cutter assembly comprising three cutter bar/frame units joined by power transmitting universal joints. Also disclosed in this patent is a tiller assembly comprising two, instead of three, such cutter bar/frame assemblies so joined and powered. U.S. Pat. Nos. 4,892,154 and 4,775,014 both disclose snow tillers having two cutter bar assemblies mounted to join together in a flexible arrangement at the center of the tiller. These disclosed arrangements require translation of the outer ends of the tiller along a bar to accommodate the flexing.

None of these tillers are adapted for independent adjustment of the cutter in elevation to work the snow at greater or lesser depths. To work the snow at greater depths requires tilting the entire tiller frame to rotate generally about the grooming end of the cutter covering structure. This is difficult, and is associated with changing the effective size of the chamber within which the cutter operates, and with greatly increased towing loads which must be overcome by the vehicle. The angle between the portion of the cover connecting with the smoothing comb or bore becomes more acute, so that drawing the comb over the tilled snow is more difficult. The internal geometry of a chamber defined by the covering apron and the surface of the snow is changed. The deeper cutting positions are accompanied by decreased chamber volumes. U.S. Pat. No. 4,775,014 in FIG. 5 discloses a capability of raising the cutter bar out of the snow and working the snow only with the snow smoothing apparatus at the rear of the tiller. However, even this is not accomplished without considerable change in geometry of the chamber beneath the covering structure.

U.S. Pat. No. 5,067,263 discloses a tiller assembly wherein the geometry of the chamber formed below the cutter covering structure may be changed by the operator in response to varying snow conditions. In this tiller embodiment, the covering structure in part comprises a flexible portion which may be altered in geometry to provide a chamber with a planar downwardly concave upper boundary. This is done with a hydraulic cylinder and ram acting upon a lever-like device, the bottom end of which is attached to the rear or trailing edge of the flexible portion. Forward movement of the connecting end of this lever buckles the flexible portion, creating the concave shape. The buckled version of the flexible sheet provides more volume within the chamber. It is maintained that the snow in the enlarged chamber continues to be pulverized the longer period of time by the spinning cutter, so as to be more thoroughly powderized. However, the bulk of the additional area is remote from the cutter, perhaps becoming substantially filled with snow. Adjustment in depth of the cutter bar into the surface of the snow in this design can also only be achieved by manipulation of the entire structure to which it is fixedly mounted, with associated difficulty in adjusting the cutting depth for varying snow conditions. Clearly, a snow tiller design for ski slope grooming is needed wherein the height of the cutter bar and the internal geometry of the cutter bar chamber may be adjusted without alteration of the attitude of the tiller upon the snow.

BRIEF SUMMARY OF THE INVENTION

With the foregoing in mind, the present invention eliminates or substantially alleviates the disadvantages and shortcomings in the prior art snow tiller devices. An elongate snow cutter bar with snow cutting and pulverizing radially outstanding teeth is mounted within an elongate covering structure, called a "box", cutter and box both mounted upon a rigid tiller frame. The box has a portion positioned above the cutter and a downwardly and rearwardly extending portion which joins with the leading edge of a snow grooming comb. The cutter beneath the covering member is fixed to the frame by a pair of brackets each pivotally attached to the frame by means of an extending pivot arm. Each bracket has another extending pivot arm connected to the frame, in this instance through a pivoting link and one of two arms of a crank member, the crank being pivotally mounted upon the frame. A hydraulic cylinder and ram acts between the other arm of the crank and the frame, to raise and lower the cutter in relation to the frame and the covering box. The depth of tilling may thus be changed without any change in position of the frame or box.

The cutter bar covering box comprises an upper portion spanning arcuately between a spaced apart pair of main members. A rear, downwardly sloping, portion is lapped by the rear edge of the upper portion at the frame member, and extends to meet the forward edge of a snow grooming comb, the latter being affixed to a third and lowermost main frame member. The leading portion of the comb is mounted at a forward and upward angle to the snow surface, through which tilled snow must pass as the tiller is drawn forwardly over the snow. The rear box portion is of flexible sheet material, and has an elongate shoe fastened to its upper surface midway of its width. The shoe is attached through an end pivoted link to an arm of a crank disposed downwardly upon the frame. The other arm of this crank is joined by an elongate, end pivoted, link to the aforementioned ram. Extension of the ram simultaneously raises the cutter and the shoe for shallow tilling. The retraction of the ram simultaneously lowers the cutter and the shoe for deeper tilling. For deep tilling, the lowered shoe bends the flexible sheet portion to restrict the aforementioned entry angle of the comb. This resists the entry of snow under the comb, causing the snow to be tilled for longer periods by the cutter, as needed for hard, crusty or icy snow. When the cutter is lifted, so is the shoe, enlarging the comb approach angle to facilitate rapid passage of the tilled snow with shorter tilling periods.

Thus the tiller operator may, in response to snow conditions, till more deeply and for longer periods or vice versa, all without tilting or otherwise adjusting the position of the tiller upon the snow.

It is therefore the principal object of the invention to provide a snow tiller device of improved performance which is more versatile in operation to changing snow conditions.

The invention as summarized above applies to individual tiller segments, two or more of which are hinged together to constitute a tiller assembly. In such assemblies a freely movable linking hydraulic cylinder/ram is used at the segment connecting hinges to limit the amount of relative flexure between the segments.

However, the linking cylinder end need not be floating, but may be pressurized to resist flexing or to place the segments into rigid relative positions when needed by snow and terrain conditions.

BRIEF DESCRIPTION OF THE DRAWINGS

In the drawings, which represent the best modes presently contemplated for carrying out the invention.

DETAILED DESCRIPTION OF ILLUSTRATED EMBODIMENT

Figure 1:
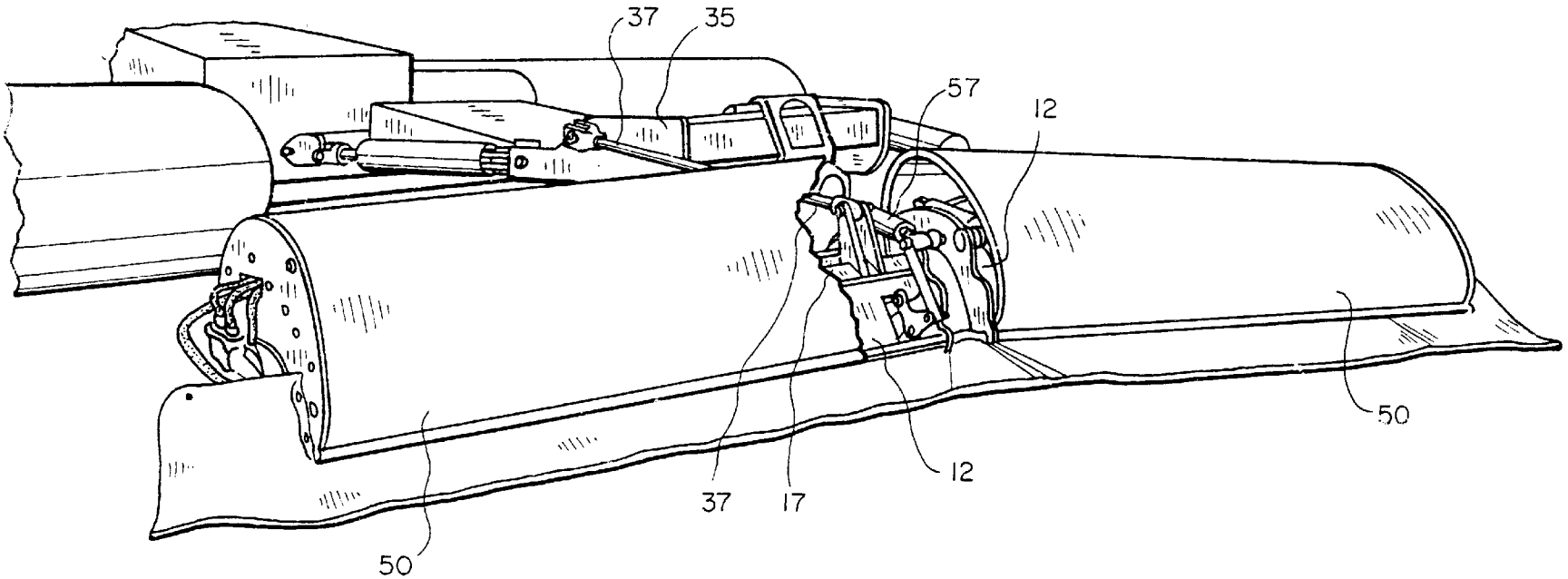
FIG. 1 is a rear perspective view of a tiller assembly in accordance with the invention connected to a vehicle to be pulled over the snow, with a protective snow cover partially cut away to show portions of the cutter bar depth and angle adjustment provisions, drawn to a reduced scale, FIG. 2 an enlarged fragment of an end portion of one of the tiller sections, showing the mechanisms for raising and lowering the cutter bar and adjusting the angle of approach to the snow smoothing comb, drawn to a larger scale than FIG. 1, FIG. 3 a bottom view of a fragment of the tiller showing the connecting universal joint and hinge pins securing the two sections together, drawn approximately the scale of FIG. 2, FIG. 4 a cross sectional view of one of the tiller sections showing the main frame members and the cutter bar pivoted hanging plates, and the crank mechanisms employed to simultaneously raise or lower the cutter bar and a shoe adjusting the angle approach to the trailing snow smoothing comb, with the cutter bar shown set deeply into the snow, drawn to a somewhat larger scale than FIG. 2, FIG. 5 the cross sectional view of FIG. 4, with the cutter bar however raised out of the snow and the angle of approach to the comb in the enlarged, non-restricting position, drawn to the scale of FIG. 4, FIG. 6 a rear elevation view of the connection of one of the tow bars, to the forward main frame of the tiller, drawn to approximately full scale, FIG. 7 a rear perspective view of fragments of the connected tiller frames, showing the crank mechanisms and the hydraulic cylinders employed in adjusting the snow cutting depth and the angle of approach to the comb, drawn to approximately the scale of FIG. 3, FIG. 8 a drawing of a prior art device incorporating a box with a flexible portion, shown in position providing a smaller chamber behind the cutting bar, FIG. 9 the device of FIG. 8, shown in the position providing an enlarged chamber behind the cutter bar, FIG. 10 a plot of the geometry of the chamber around the cutter bar of the present invention, indicating the cross sectional area thereof, FIG. 11 a plot of the area corresponding to that of FIG. 10, with the cutter bar however raised upwardly out of the snow, and FIG. 12 a drawing showing the connection of the tiller section tow bars to a central pivot pin secured to a device for joining with the towing vehicle, drawn to the approximate scale of FIG. 6, FIG. 13 a drawing indicating a hydraulic fluid manifold used to selectively pressure ram or piston sides of the tiller segment linking hydraulic ram and cylinder assemblies, FIG. 14 a diagramatic representation of a two segment tiller allowed to rotate unrestrained by the linking cylinder and ram assembly, when tilling hard snow, FIG. 15 a diagramatic representation of the tiller of FIG. 14, when tilling soft or powdery snow, and FIG.16 a schematic representation of the control system for pressurizing selected sides of the piston of the linking hydraulic ram and cylinder assembly.
Figure 2:
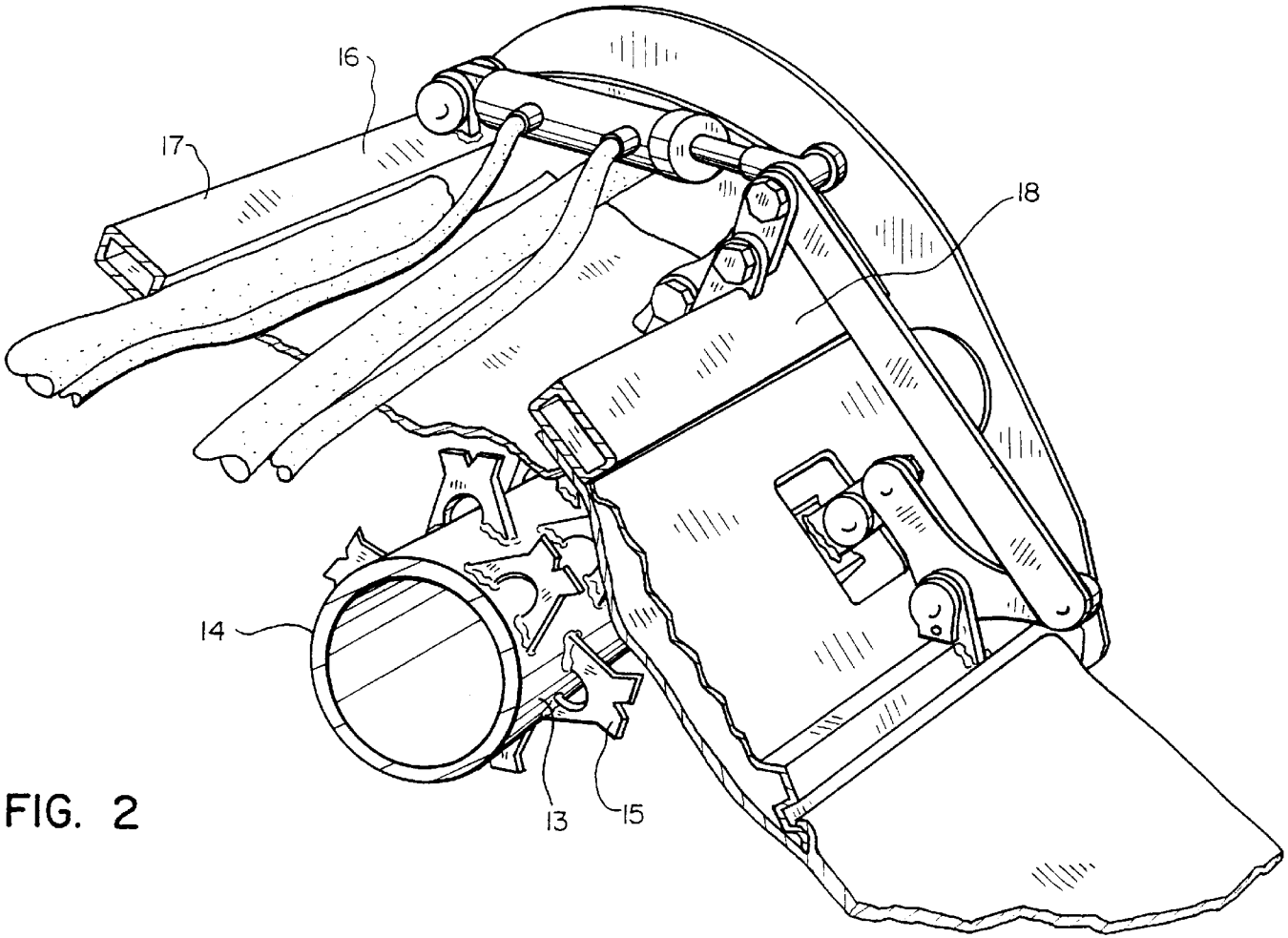

In FIG. 1, a snow tiller 10 with a variable snow comb approach angle in accordance with the invention is illustrated connected to a tracked vehicle 11, ready to be towed along a path of snow. Tiller 10 comprises a pair of tilling assemblies 12, including elongate cutter bar assemblies 13 each comprising an elongate drum 14 with radially outstanding snow cutting teeth 15. (FIG. 2) Each tiller assembly 12 further comprises a unitary frame 16 including main frame upper forward and rearward members 17 and 18 respectively, from which the cutter bar 13 is suspended pivotally through cutter bar outside and inside end mounting plates 19*o* and 19*i*, as later described. A lowermost frame member 18*c* has an upwardly opening channel to which a trailing snow comb 56 is attached, and is also welded to end plates 19*o* and 19*i*.

Figure 3:
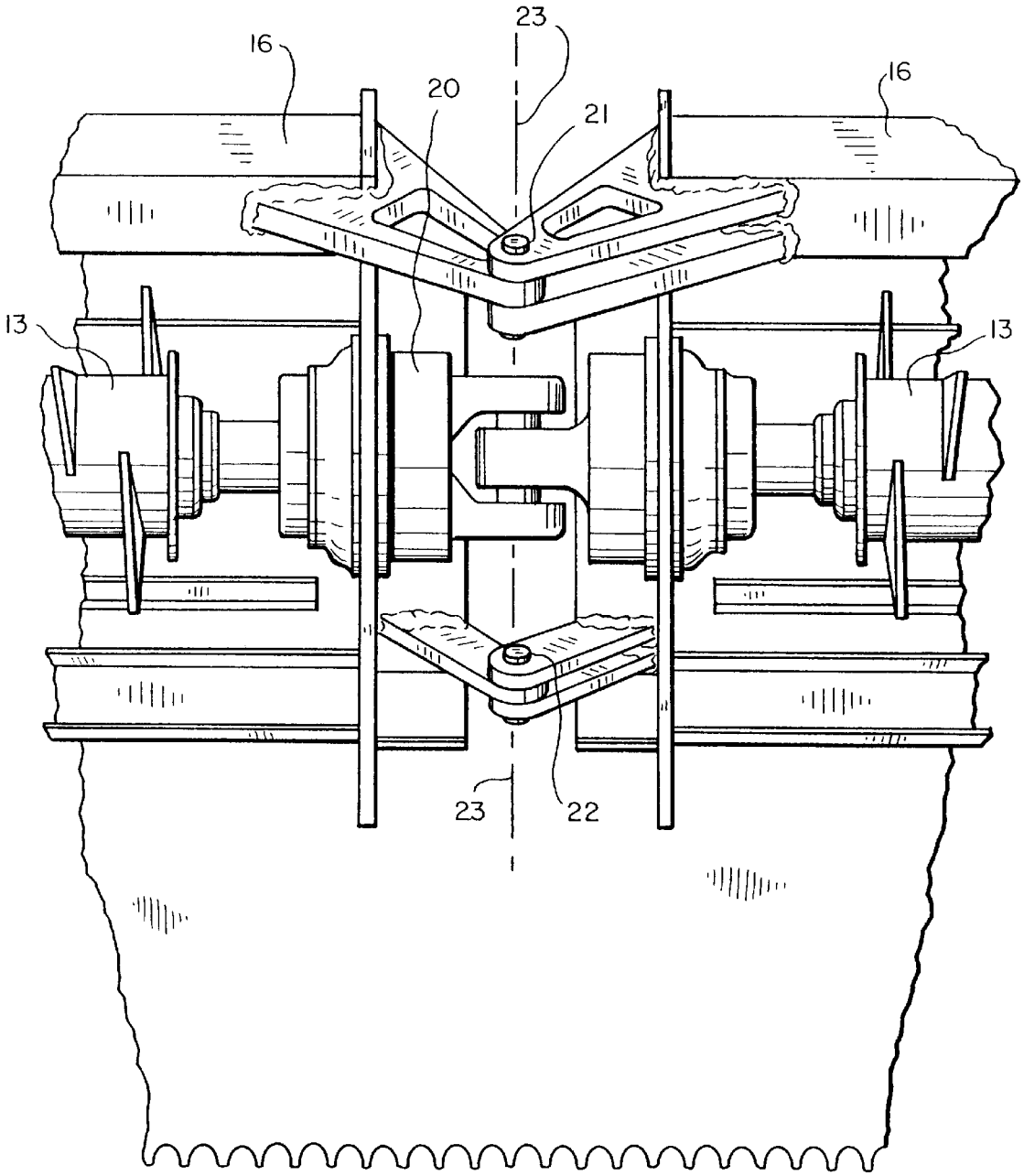

The individual tiller assemblies 12 are joined through a power and rotation transmitting universal joint 20 connecting the inside ends of the cutter assemblies 13. The unitary frames 16 are further connected through upper and lower hinge pins 21 and 22 respectively, having a common pivot axis 23 which passes through the center of rotation 24 of universal joint 20. (FIG. 3)

Figure 7:
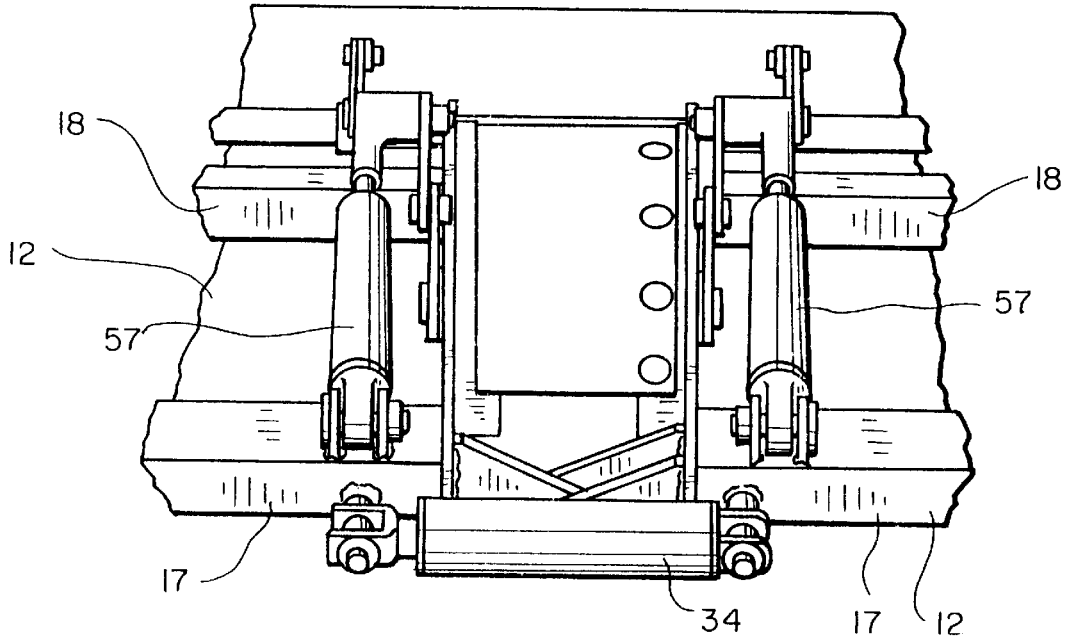
Figure 12:
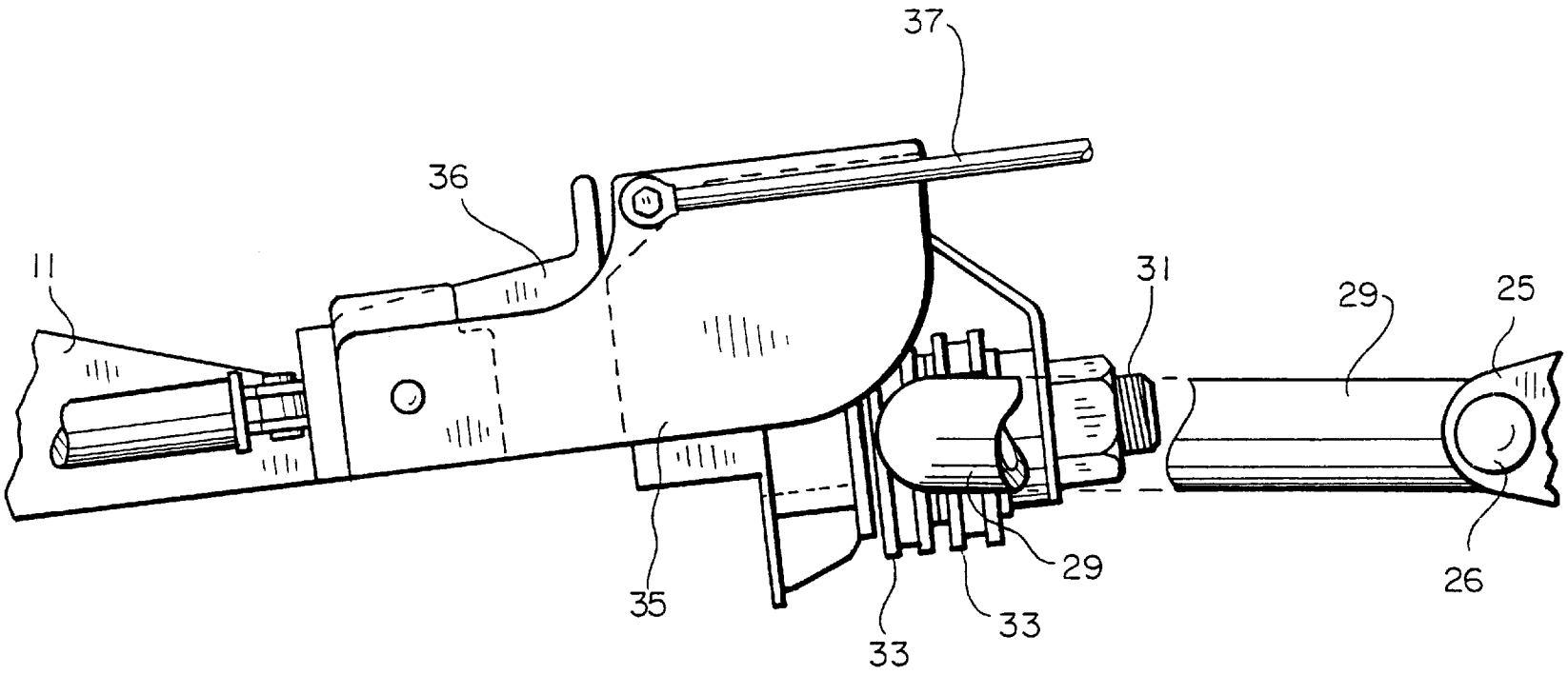

Positioned centrally upon each upper main frame member 17 is a pair of pivot posts 25 carrying a horizontal laterally directed pivot pin 26 engaging a pivot bore, not shown, in end member 28 of one of a pair of generally "L"-shaped towing bars 29. The towing bars are pivotally connected through inside end members 30 to a central towing rod 31 through bores, not shown, in leaves 33. (FIG. 12) Each towing member 29 rotates about central towing rod 31 in response to vertical motion of the associated tiller assembly 12 as it rotates about universal joint 20. Associated lateral movement at the center of each tiller assembly 12 is accommodated by sliding space provided by widely spaced posts 25, and by a spherical bearing, not shown, between pivot pin 26 and the tow arm pivot bore. Excessive flexing between the two tiller assemblies 12 is prevented by a hydraulic cylinder and ram 34 acting between the inside ends of the upper main frame members 17. (FIG. 7) Central towing rod 31 is integral with a structure 35 for connecting the tiller assembly 10 to a towing connector assembly 36 carried rearwardly on vehicle 11. (FIG. 12)

The operating position of tiller 10 upon the snow is fixed by a pair of top links 37 attached between tow connection structure 35 and the rearmost upper main frame member 18. For normal operation, tiller 10 is in a position placing the lower edge 38 of tiller end plates 39 along the surface of the snow. (FIGS. 4 and 5)

In FIG. 1, a protective uppermost snow cover 50 is shown partially cut away, providing a view of the uppermost surface of one of the individual tiller assemblies 12. A cutter assembly housing 51, called a "box", comprises a curved top section 52 of ultra high molecular weight plastic spanning between and secured as by bolts 51*b* to upper frame members 17 and 18 above cutter assembly 13. A lower box section 53 of polyurethane sheet slopes downwardly from rearmost frame member 18 to a trailing edge 54, there secured to foremost edge 54e of comb 56.

Figure 4:
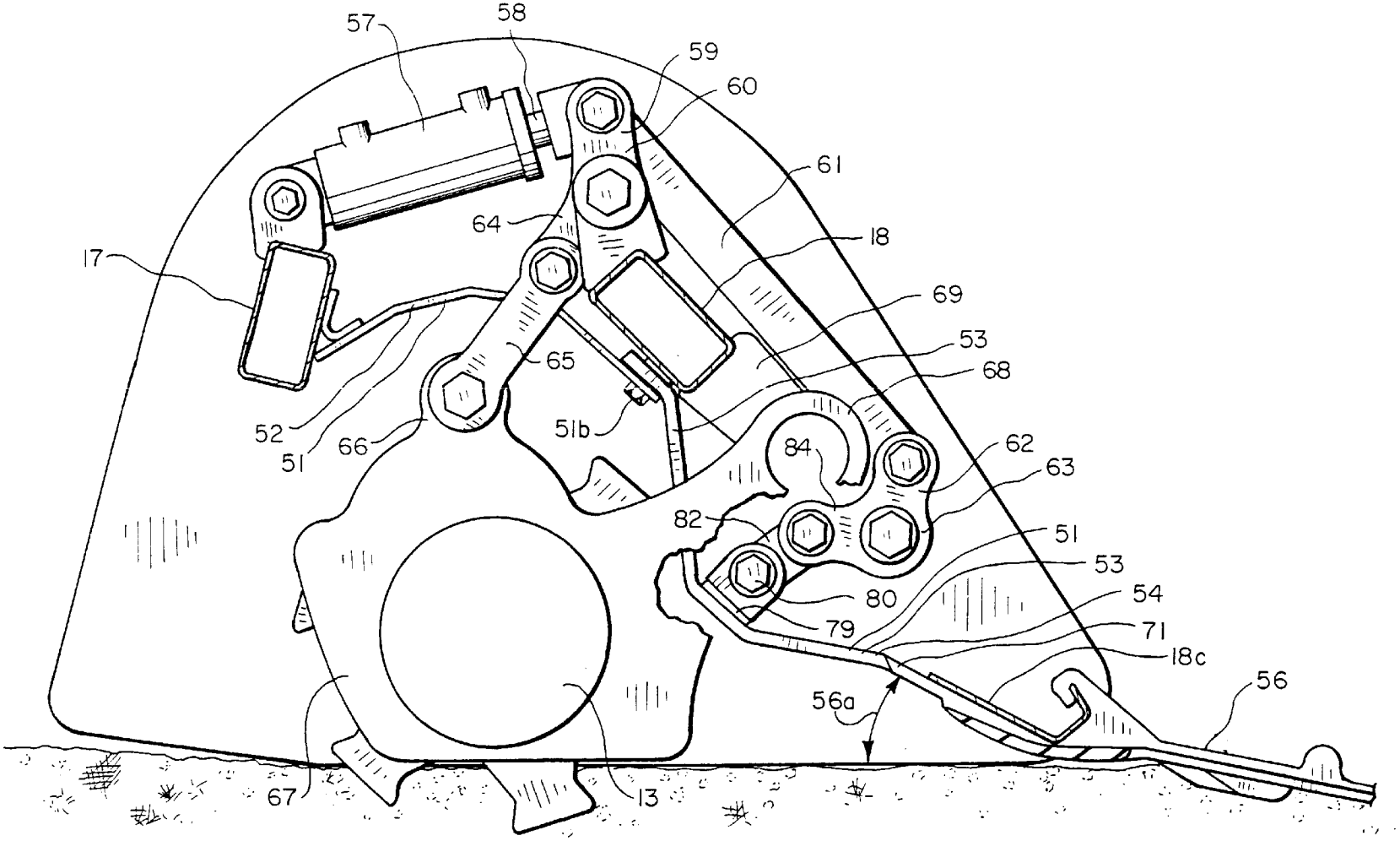
Figure 5:
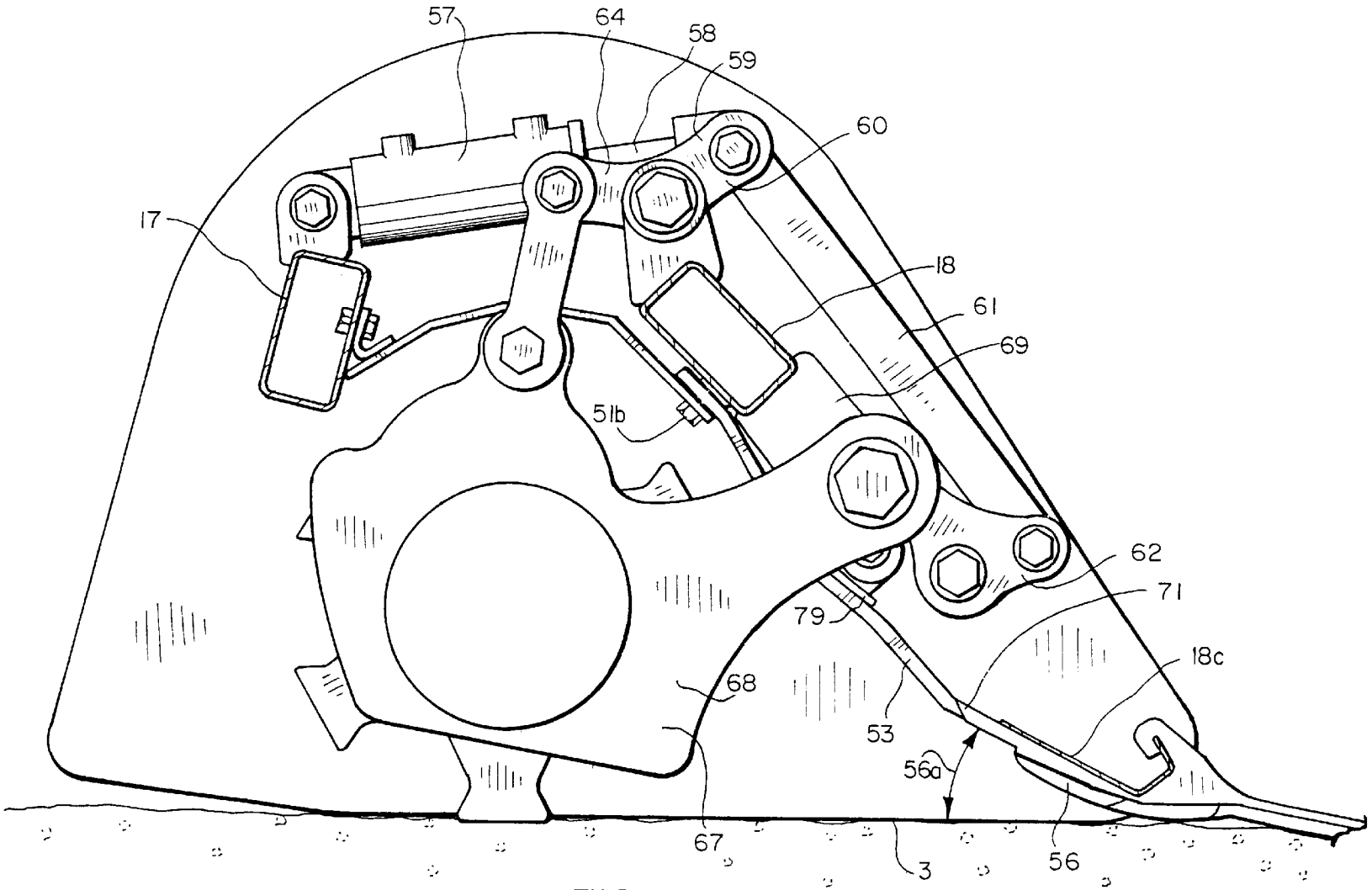
Figure 6:
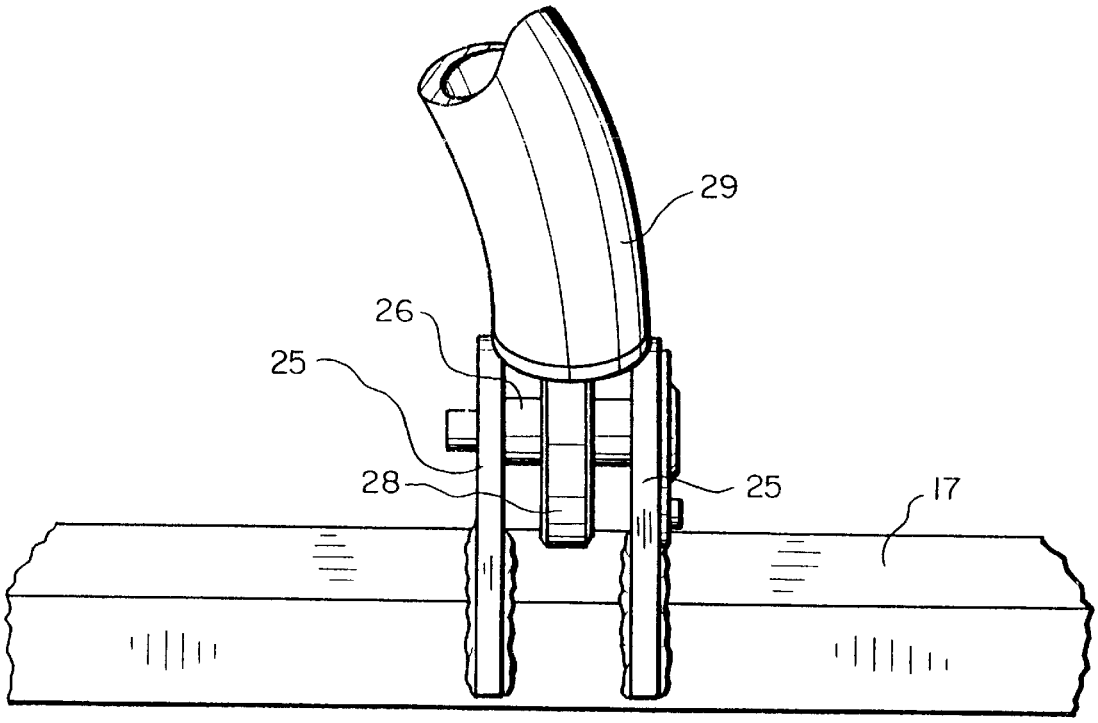

Seen in FIGS. 4 and 5 is a hydraulic cylinder 57 with an associated ram 58, the former pivotally joined to forward upper frame member 17 and the latter to the upper arm 59 of an upper bell crank 60 which is pivotally joined at its center to rear upper frame member 18. Also pivotally joined to ram 58 is an elongate push-pull rod 61 sloping rearwardly down to connect pivotally with a rearmost arm 62 of a lower rearmost, bell crank 63, the function of which is subsequently discussed.

Lower arm 64 of upper bell crank 60 is pivotally joined to a linkage member 65 connected pivotally with an upper arm 66 of one of the cutter assembly hangers 67. A lower arm 68 of each hanger 67 is pivotally joined with lower frame member 18 through a bracket 69. As indicated in FIG. 4, withdrawal of ram 58 from extended position (FIG. 5) rotates upper bell crank 60, causing downward movement of lower arm 64 and linkage 65, so that cutter hanger plate 67 rotates about a pivotal connection to bracket 69. This lowers cutter assembly 13 to cut more deeply into the snow when this is desired. No concomitant rotational or elevational change in the position of the box 51, nor of the unitary frame 16, nor of cutter assembly 13 is required. For upward adjustment of cutting depth, ram 58 is extended.

Lowermost frame member 18*c* is shaped to position leading edge 71 of comb 56 at the desired angle 56*a* with the snow surface. The trailing edge of lower box section 53 of polyurethane sheet abuts comb leading edge 71. The upper edge of flexible portion 53 is secured slideably to rearmost upper frame member 18, as by elongate slots, not shown, engaging the bolts 51*b*.

An elongate shoe 79 secured to the upper surface of flexible lower box section 53 carries a pivotal assembly 80 secured to the lower end of a lower linkage member 82. The upper end, not shown, of member 82 is pivotally joined with a forwardly extending arm 84 of rear bell crank 63.

Cutter assembly 13 is typically raised to a higher position when used in softer or looser snow requiring less chopping and pulverizing. When cutter assembly 13 is raised by extension of ram 58, push-pull rod 61 rotates rear bell crank 63 to lift linkage 82, shoe 79, and flexible section 53. (FIG. 5) With cutter assembly 13 and lower box section 53 in these positions, the flexible section offers less impediment of snow movement toward comb leading edge 71 and under comb 56, and toward the area under comb 56 for final smoothing and/or patterning.

Figure 9:
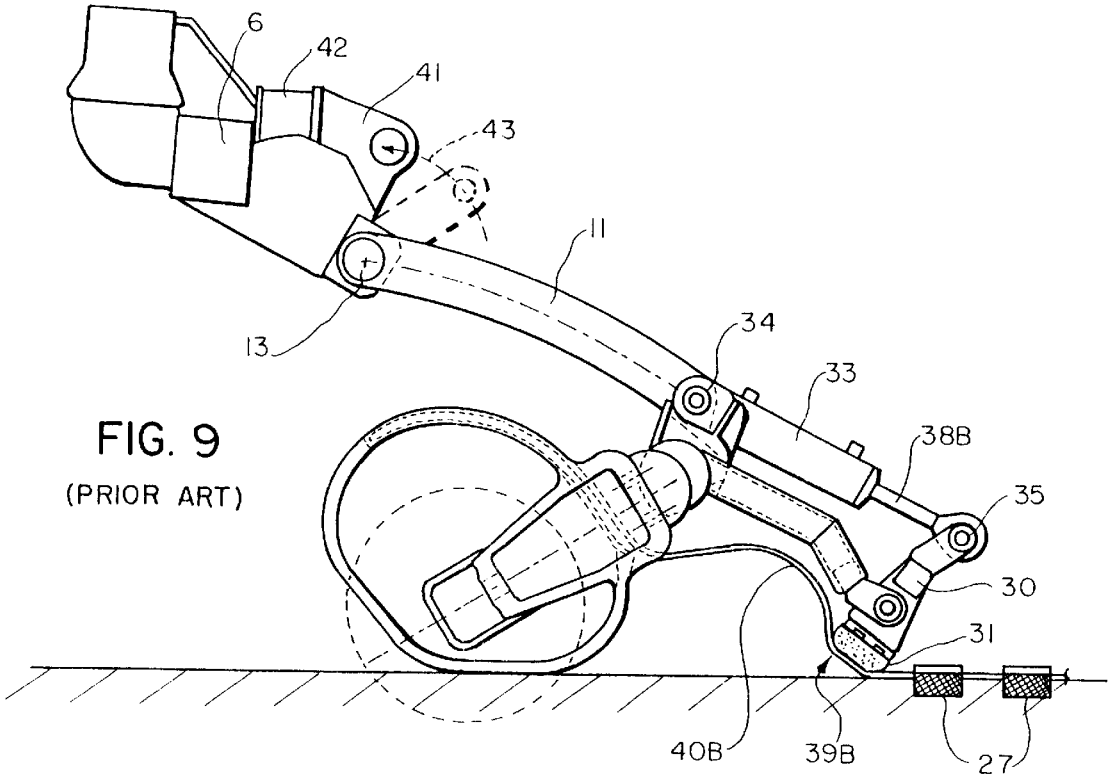
FIG. 9 (PRIOR ART)
Figure 8:
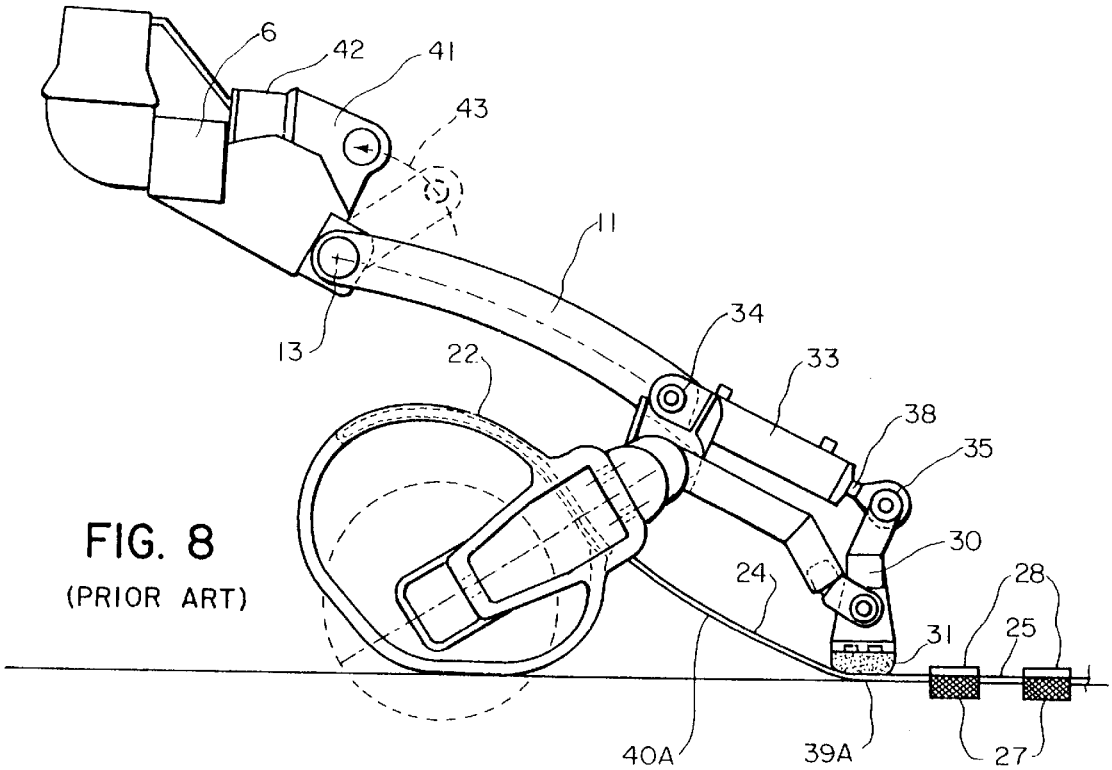
FIG. 8 (PRIOR ART)
Figure 11:
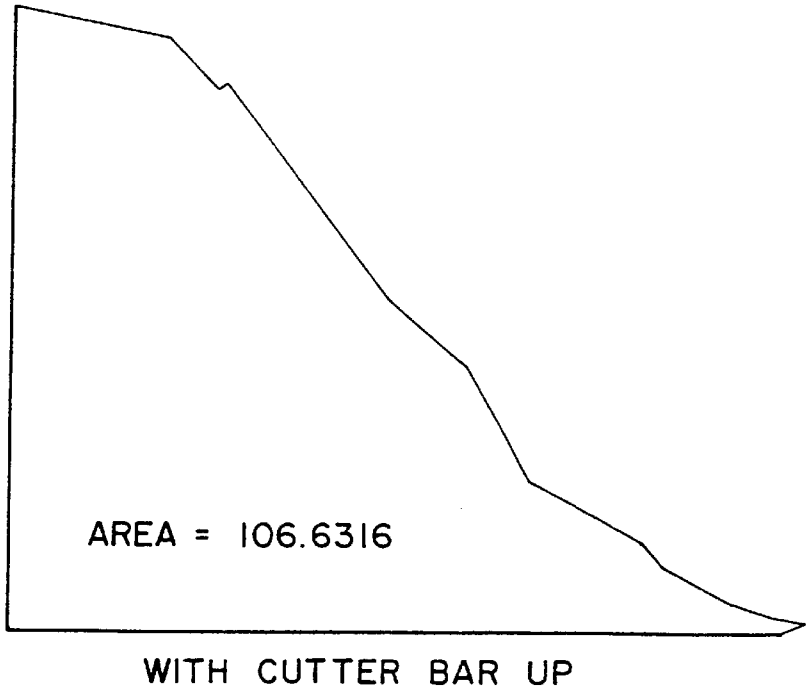
Figure 10:
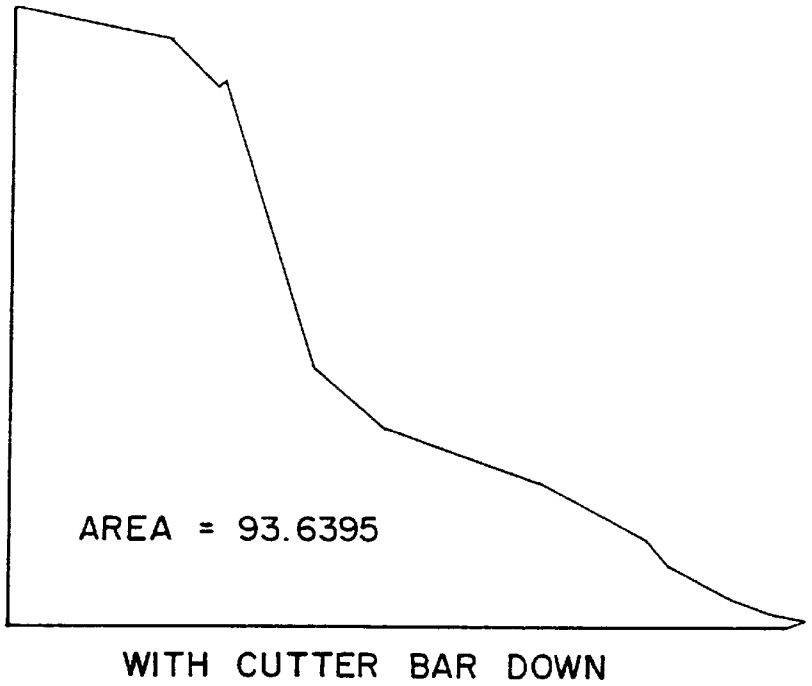

In contrast, when the snow is harder, perhaps crusted, deeper more prolonged chopping and pulverizing is needed. In this situation, ram 58 is retracted, simultaneously lowering cutter assembly 13 and shoe 79, as described above. The approach to the comb leading edge 71 is now relatively constricted, impeding the drawing of the comb over the tilled snow, and retaining the snow in a position proximate to the cutter teeth 15 for longer tilling periods. It is noted that the operation of tiller assembly 12 is directly opposite to that of the prior art variable geometry design (Prior art (FIGS. 8 and 9) In this prior design, a flexible section (24) of the box is manipulated into a configuration 40-B, (Prior art FIG. 9), to provide a larger chamber behind the cutter to retain the snow longer when snow conditions require more prolonged tilling. Whether the prior art device actually operates in this manner may be questionable. In any event, the operation of the present device, tiller 10, is not dependent upon change of volume of the chamber, but rather upon change of resistance to entry of snow into the space below the leading edge of the comb for final smoothing. Any change in chamber area is incidental, limited to a few percent. It also occurs oppositely to the change associated with the prior art device. In tiller 10, the larger chamber volume occurs when the tiller is adjusted for lighter snow, rather than for heavier snow requiring more prolonged tilling. (FIGS. 10 and 11)

An embodiment of tiller 10, not providing for the variable geometry box, but retaining the capability of raising and lower the cutter without changing the position of the box or the tiller frame would be a very desirable improvement over many prior art tiller designs. This feature would, as previously mentioned, permit adjustment of tilling depth without the concomitant necessity of tilting the entire tiller with associated increased power requirements. This envisioned embodiment would result from eliminating the push-pull rod 61, the lower bell crank 63, the linkage 82 and the shoe 79. The flexible section of the box, if retained, would then be inoperable.

The controlled variable snow comb entry angle coordinated with controlled raising and lowering of the cutter bar without movement of the tiller frame is the essence of the invention. Whether the tiller includes one, two or more flexibly connected sections is immaterial to the invention, which is applicable to each of the sections of all such tillers. Other changes are also within the spirit of the invention, which is defined by the following claims and all other embodiments within the meaning and range of equivalency thereof.

Figure 14:
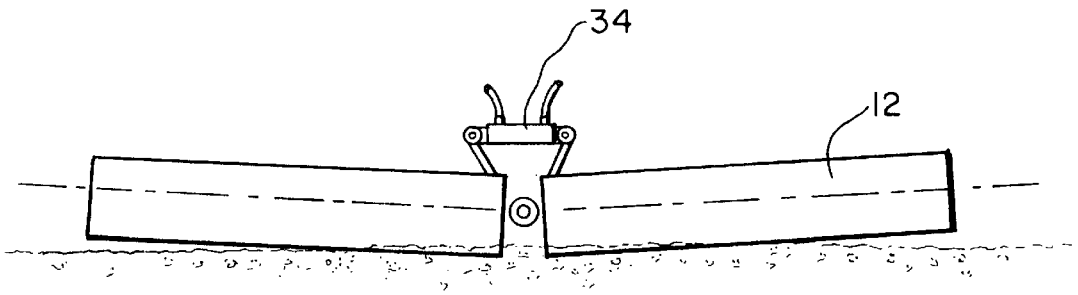
Figure 15:
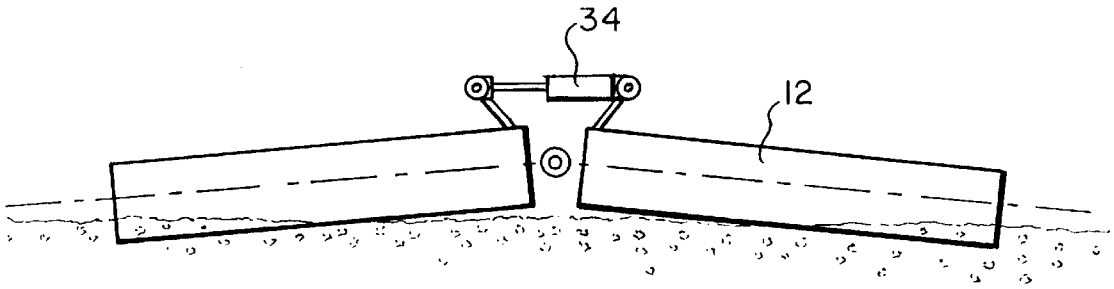
Figure 16:
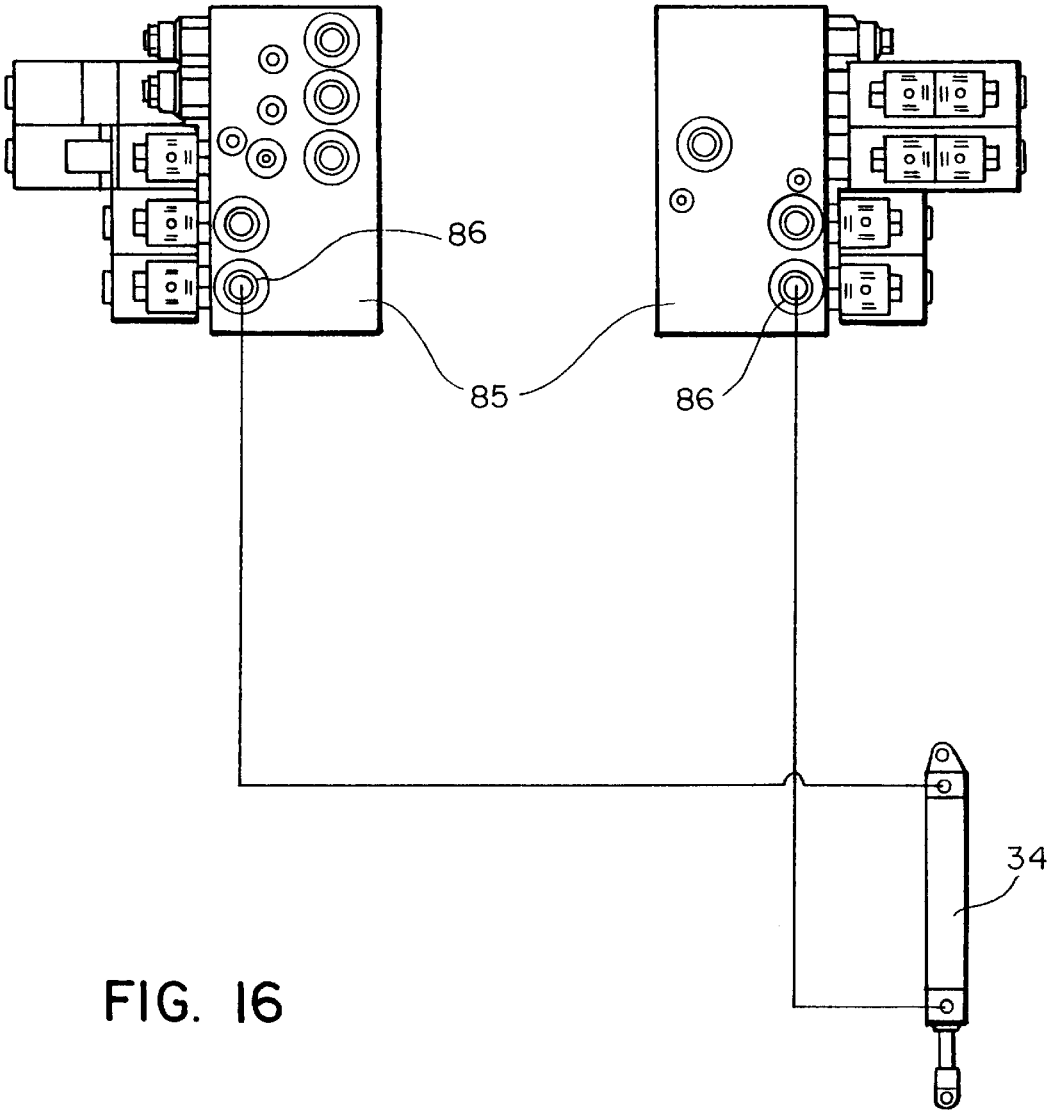

The unpressurized, angle limiting cylinder 34 allows undesirable segment to segment angles in some snow conditions. For example, in hard or crusted snow, the outer ends of the tilling assemblies 12 (in a two tiller assembly) may tend to lift upwardly, resulting in a snow path tilled more deeply at its center than at its edges. (FIG. 14) The opposite may occur where a path of very soft snow is plowed. (FIG. 15) Similarly, when paths of uneven snow are plowed, the freely floating tilling assemblies may conform, frustrating the desired leveling of the path.

Figure 13:
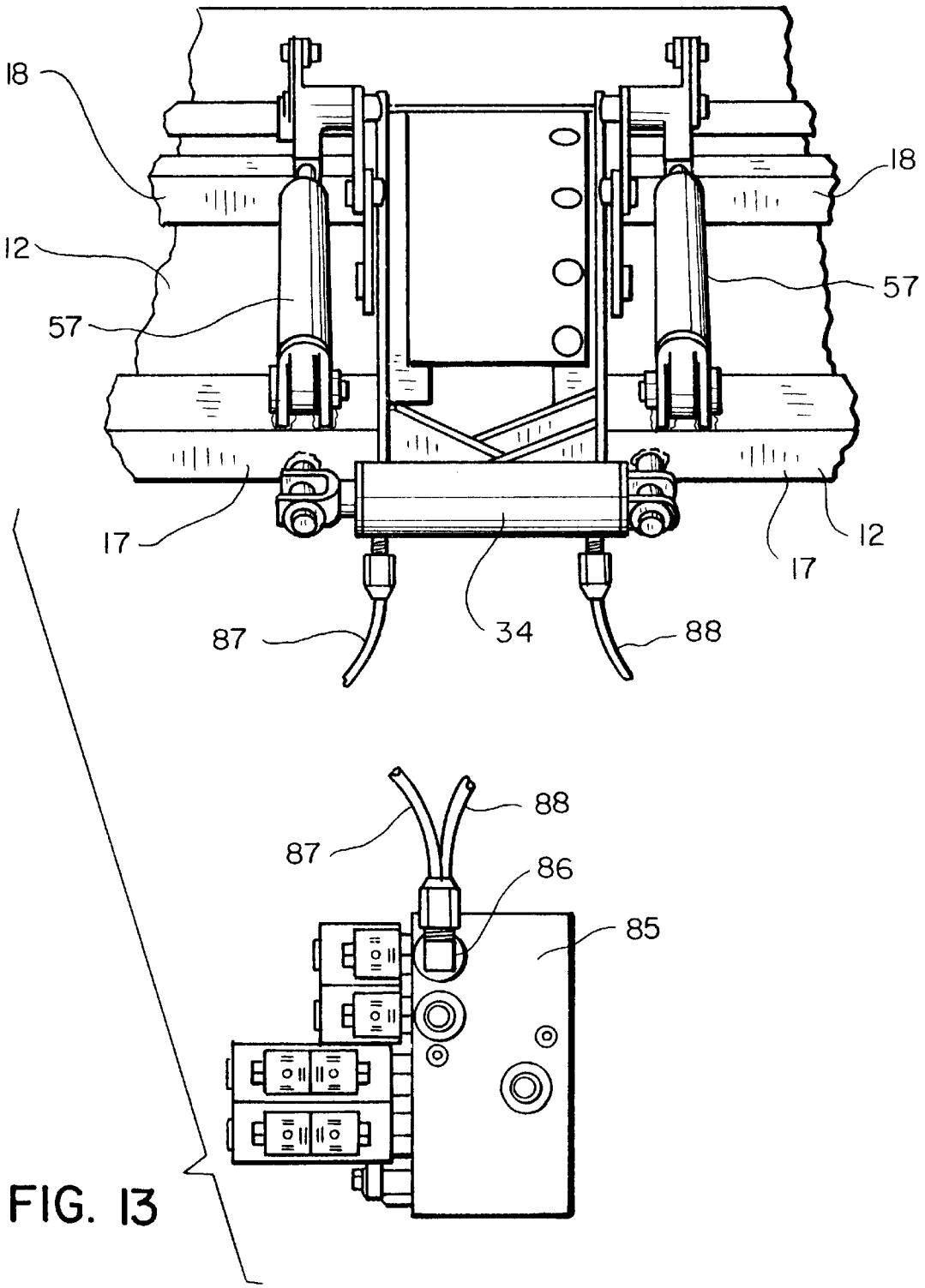

To obviate these undesirable operational traits, one embodiment of the invention provides for controlled pressurization of a selected side of the piston of hydraulic ram and cylinder 34. (FIGS. 13–16) Preferably, the pressurized fluid to cylinder 34 is provided through a fluid manifold 85 from a selector valve 86 through line 87 or 88 to its ram or piston head side respectively. In this manner, alignment of the tiller assemblies 12 can be controlled by operator, so that the cutter bar performs with improved effectiveness. The manifold 85 is secured to lift frame 29, not shown in FIG. 13, and is preferably also used to direct fluid to cylinders 57 for raising and lowering cutter bar 13 and flexible section 53.

I claim:

1. A device for tilling the surface of a path of snow along which said device is drawn, comprising:

a rigid unitary frame;

at least two elongate horizontal snow cutters;

an elongate covering structure disposed above and behind each cutter, a rearmost portion thereof extending downwardly and rearwardly to meet a leading edge of a snow surface grooming device affixed rearmost to the tilling device, forming an angle of entry of snow to under the grooming device; and a means of varying the elevation of the cutters within the covering structure without change in angular or elevational position of the said frame, covering structure and grooming device upon the snow; and wherein the cutters are connected by a universal joint and a pivotal connection having an axis of rotation passing through the center of rotation of the universal joint, and by a hydraulic ram and cylinder assembly mounted so that relative rotation of the cutter ends causes the ram to move relative to the cylinder, said hydraulic ram and cylinder assembly comprising a piston connected to an end of the ram within the cylinder assembly, said piston having a head side facing away from the ram and an oppositely facing ram side.

2. The snow tilling device of claim 1, wherein the means for varying each cutter elevation comprises:

an upper forward crank mounted pivotally to the frame at each cutter mounting plate, said upper forward crank having a pair of arms extending therefrom;

an elongate link with a pair of ends, one of said ends being pivotally joined to one of the arms of the crank and the other of said ends being joined to an associated cutter suspending mounting plate; and means rotating the crank to pivot the mounting plate to vary the elevation of the cutter.

3. The snow tilling device of claim 2, wherein the means for rotating the crank comprises:

the aforesaid hydraulic ram and cylinder assembly, the cylinder of said assembly being secured pivotally to the frame and the ram being pivotally secured to the arm of the crank which is not pivotally joined to said elongate link.

4. The snow tilling device of claim 3, wherein:

the downwardly and rearwardly extending portion of each cutter covering structure comprises a sheet of flexible material having an upper side; and the device further comprises a means of varying each angle of entry of the snow simultaneously with the variation of the elevation of each cutter.

5. The snow tilling device of claim 4, wherein each angle varying means comprises:

an elongate shoe secured to the upper side of the flexible sheet, said shoe running parallel to the cutter;

a lower rearward crank comprising an other pair of arms which extend from said lower rearward crank, said crank being mounted pivotally to the frame;

a link member with a pair of ends, one of said ends being pivotally joined to one of said other pair of arms of said lower rearward crank and the other of said ends being pivotally joined to the shoe;

an elongate rigid member having an upper and a lower end, said upper end being pivotally joined to the arm of the upper crank which is not pivotally connected to one end of the elongate link which is joined to an associated cutter mounting plate, and said lower end being pivotally connected to the arm of said lower rearward crank which is not connected to the link member which joins pivotally to the shoe; and the hydraulic ram and cylinder assembly being mounted so that relative rotation of the cutter causes the ram to move relative to the cylinder, said hydraulic ram and cylinder assembly comprising a piston connected to an end of the ram within the cylinder assembly, said piston having a head side facing away from the ram and an oppositely facing ram side.

6. The snow tilling device of claim 1, wherein:

the hydraulic ram and cylinder assembly is adapted to be pressurized selectively by hydraulic fluid on the head side of the piston contained therein to which the ram is attached or upon the ram side of said piston, and the tilling device further comprises a source of pressurized hydraulic fluid, hydraulic fluid conduit means from said source to said sides of the piston, and an operator controlled selector valve means directing pressurized fluid to one or the other of said sides of the piston.

7. The snow tilling device of claim 5, wherein:

the hydraulic ram and cylinder assembly is adapted to be pressurized selectively by hydraulic fluid on the head side of a piston contained therein to which the ram is attached or upon the ram side of said piston, and the tilling device further comprises a source of pressurized hydraulic fluid, hydraulic fluid conduit means from said source to said sides of the piston, and an operator controlled selector valve means directing pressurized fluid to one or the other of said sides of the piston.

* * * * *